United States Patent [19]

Chavez

[11] Patent Number: 4,867,506

[45] Date of Patent: Sep. 19, 1989

[54] WHEELCHAIR TRAY SLIDABLE COIN DRAWER

[76] Inventor: Ruben E. Chavez, 4451 W. Solano Dr., S., Glendale, Ariz. 85301

[21] Appl. No.: 232,015

[22] Filed: Aug. 15, 1988

[51] Int. Cl.[4] ..... A47C 7/68

[52] U.S. Cl. ..... 297/188; 108/26; 108/42; 206/0.81; 297/153; 297/DIG. 4; 235/304.1

[58] Field of Search ..... 297/148, 149, 153, 160, 297/161, 188, 192, DIG. 4; 108/26, 42, 49, 93; 312/345; 206/0.81, 0.84, 564; 280/289 WC

[56] References Cited

U.S. PATENT DOCUMENTS

| | | | |
|---|---|---|---|
| 36,734 | 10/1862 | Snow | 206/0.81 |
| 137,738 | 4/1873 | Trevitt | 297/194 X |
| 886,345 | 5/1908 | Burns | 206/0.81 |
| 1,349,527 | 8/1920 | Owen | 206/0.81 X |
| 1,857,522 | 5/1932 | Vugeheuer | 108/26 X |
| 2,535,112 | 12/1950 | Woody | 108/49 X |
| 4,659,099 | 4/1987 | Malone | 297/153 X |

*Primary Examiner*—Peter R. Brown
*Attorney, Agent, or Firm*—Kenneth R. Bowers, Jr.

[57] ABSTRACT

A tray for a wheelchair adapted for persons having reduced grasping strength. The tray supports a drawer for holding currency, especially coins. The bottom of the drawer is curved to allow removal of coins by sliding movement up the side of the drawer without grasping the coin.

2 Claims, 3 Drawing Sheets

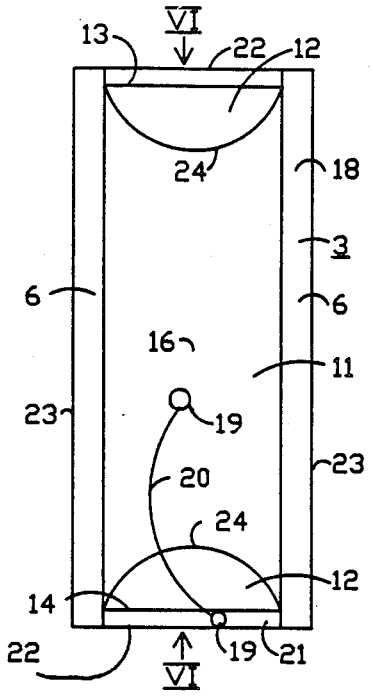
FIG. 5
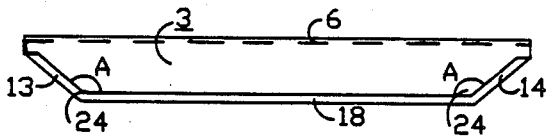
FIG. 6
FIG. 7
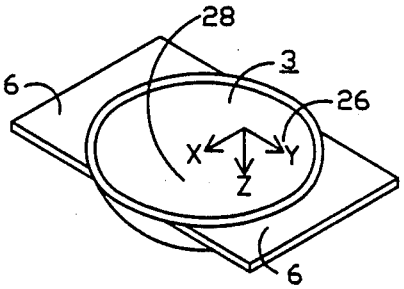
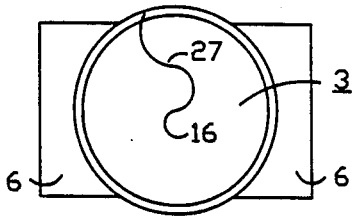
FIG. 8

WHEELCHAIR TRAY SLIDABLE COIN DRAWER

BACKGROUND OF THE INVENTION

1. Field of the Invention

This invention relates to wheelchairs generally, and to appliances designed for attachment to a wheelchair, especially an appliance for holding and dispensing coins and other objects.

2. Description of the Prior Art

Many devices for attachment to a wheelchair are taught by prior art. United States Patent 3,020,085 to Russell illustrates a tray which attaches to the side handles of a wheelchair. The tray has a drawer 38 (see FIG. 2) which is suspended below the tray and which is available for the storage of small items.

SUMMARY OF THE INVENTION

A food and item tray, attachable to a wheelchair, with a storage drawer having curved surfaces in all three geometric dimensions to enable removal of coins and other objects by a handicapped person unable to grasp a coin but able to exert slide-inducing pressure and force on the coin. The tray may be circular or elliptical in cross section and may have ramped ends so that a coin in the bottom of the drawer can be removed entirely by sliding along a path which does not include a step which blocks further sliding. Because the tray slides in two directions forward and backward under the tray, the drawer can be opened from both the front and the rear, enabling both the occupant of the wheelchair and another person to have convenient access to the drawer and its contents and both persons can remove the contents even if both are handicapped.

A principle object of the present invention is to provide a tray, attachable to conventional wheelchairs, having a drawer adapted to hold small objects, especially coin money.

A second object is to structure the drawer so that coins and other small objects can be removed from the drawer by a person who is handicapped and cannot grasp objects.

BRIEF DESCRIPTION OF THE DRAWINGS

FIG. 5 is a plan view of the drawer.

FIG. 6 is a section of the drawer as shown in FIG. 5.

FIG. 7 is a perspective view of a preferred embodiment of the drawer in which the drawer is a section of a hollow sphere.

FIG. 8 is a plan view of the drawer as shown in FIG. 7.

DETAILED DESCRIPTION

Figure 1:
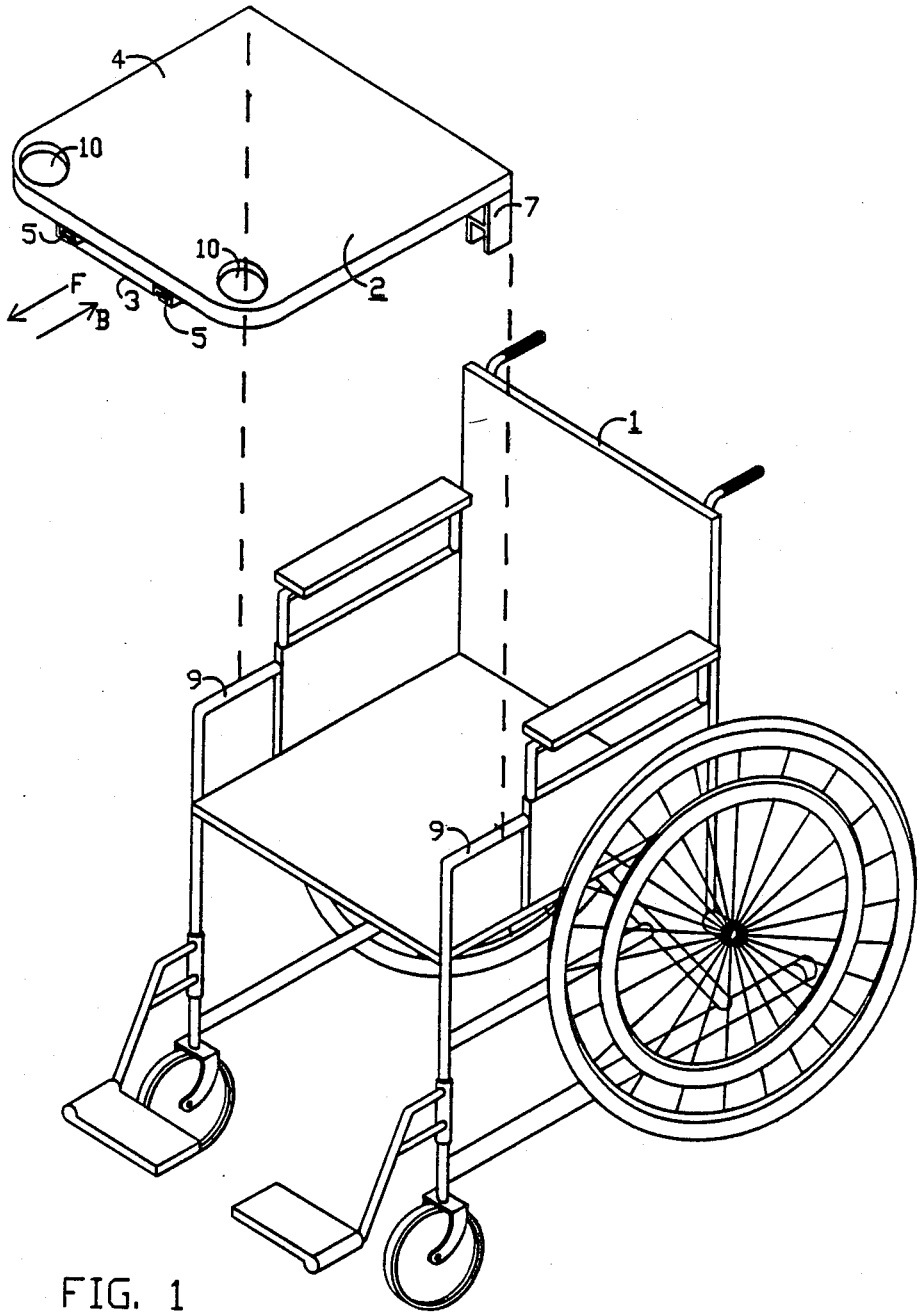
FIG. 1 is a perspective view of the tray and its drawer as exploded away from the wheelchair.

In the drawings and in this specification, similar reference numerals denote similar elements.

Refer to FIG. 1. This figure illustrates a wheelchair 1, a conventional and commercially available vehicle for seating and transporting injured or ill persons. Wheelchair 1 forms no part of the invention and its inclusion in the drawings is to illustrate the placement of the tray.

After a person is seated in a wheelchair 1, a tray 2 can be installed by attachment to wheelchair 1. The upper surface 4 of tray 2 is used for many purposes such as writing and dining, and according to the employment of the user may be the equivalent of a business table or desk. Tray 2 supports a drawer 3 which is intended to enable the user to store and dispense coins, paper money, paper tickets, and the like, in connection with business activities.

Drawer 3 is slidable in two directions, labeled F (for forward) and B (for backward) in FIG. 1. If drawer 3 is shifted along B to clear tray 2, access to the interior of drawer 3 is available to the person seated in wheelchair 1. If drawer 3 is shifted along F to clear tray 2, access to the interior of drawer 3 is available to a custormer standing in front of wheelchair 1. The user of wheelchair 1 can shift drawer 3 forward or backward to dispense objects.

Figure 2:
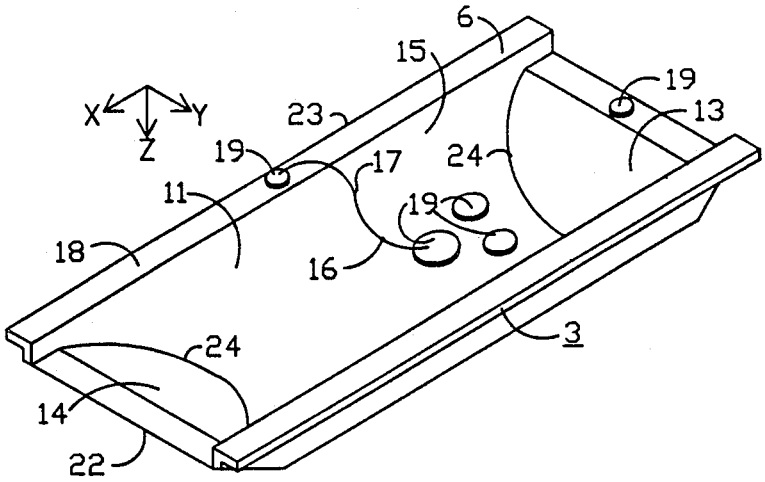
FIG. 2 is a perspective view of the drawer as removed from the tray.
Figure 3:
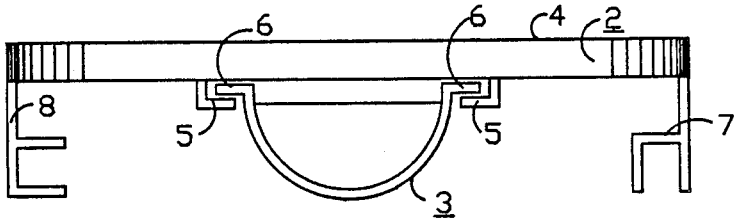
FIG. 3 is a front elevation view of the drawer installed on the tray.

Refer to FIG. 3. Drawer 3 is shown to depend from tray 2 by insertion into brackets 5, also visible in FIG. 1. Flanges 6, shown in FIG. 2, mate with brackets 5 and are slidable along F and B. For clarity in the Figures, an exaggerated clearance between flanges 6 and brackets 5 is indicated, but in practice the clearance would be minimized to prevent wobble or accidental release of drawer 3. The drawings do not show any provision for a stop to prevent drawer 3 from being withdrawn entirely out of brackets 5 and thereby separated entirely from tray 2. In practice, it is contemplated that drawer 3 will have means to limit travel along F to prevent removal of drawer 3 from tray 2 in the direction of F, but removal by movement of drawer 3 along B will be permitted. This arrangement provides the user of wheelchair 1 with control over drawer 3.

FIG. 1 and 3 show means for attachment of tray 2 to wheelchair 1. Clamps 7 and 8 are fixed to tray 2 and snap over a section 9 of wheelchair 1. Section 9 is a tubular member functioning generally as part of the support frame of wheelchair 1. Clamp 7 is disposed to snap over section 9 by downward movement, while clamp 8 snaps over section 9 by a sideward movement which is 90 degrees removed from the motion required to install clamp 7. The act of installing tray 2 thus involves two dissimilar movements and will not be duplicated by a single force applied to tray 2. It is unlikely that an accidental blow to tray 2 will cause tray 2 to separate from wheelchair 1.

FIG. 1 shows a plurality of holes 10 in surface 4 of tray 2. These holes are intended to support any of several specially designed tools and instruments such as a lamp, an electric stapler, an electric scissors, and others used in business. Naturally holes 10 can also support a coffee cup and the like.

Many persons who use wheelchairs are handicapped in that they have difficulty in grasping objects because their fingers are too weak to seize an object with sufficient force to pick it up. In the absence of an alternate method of handling such objects as coins, paper money, theater tickets and the like, the person may be denied employment in a particular business. Refer to FIG. 5. Surface 11 in this Figure defines a section of a cylinder while surfaces 12 are ramps which lead from the bottom of the trough 15 formed by surface 11. There are two ramps 13 and 14 in FIGS. 2, 5 and 6. Rear ramp 13 is on the end of drawer 3 toward the person in wheelchair 1 while forward ramp 14 is on the end of drawer 3 toward the front of wheelchair 1. It is possible to remove a coin from the bottom of trough 15 by pressing downward on the coin and sliding it upward on curved surface 11. Suppose that there is a coin 19 at point 16 in the bottom of trough 15. The coin can be moved up path 17 until the coin rests on surface 18 of drawer 3. Alternatively, coin 19 can slide up path 20 (in FIG. 5) until coin 19 rests on surface 21 of drawer 3. With coin 19 resting on either surface 18 or 21, it is easy to slide the coin over edge 22 of 23 of the surface to fall into a human hand or it may then be possible to grasp an edge of coil 19 which is extending somewhat over edge 22 or 23.

In order that a coin will slide easily up and out of drawer 3, surface 11 of trough 15 should everywhere be a continuous, smooth curve such that every path 17 which may be chosen encounters no obstacle such as a ridge or a step upon which coin 19 could become captured before reaching the boundary of the enclosure of the drawer. Surfaces 12 of ramps 13 and 14 must be smooth and the intersections 24 between ramps 13 and 14 must be free of a discontinuity large enough to capture a coin. Refer to FIG. 6. In this Figure, angle A is defined as the angle formed between ramps 13 and 14 and surface 11 at intersections 24. Each angle A must be large enough to enable a coin to slide easily up path 20. In practice, it is found that angles A should be 130 degrees or greater.

FIGS. 7 and 8 illustrate a preferred embodiment in which drawer 3 is a section of a hollow sphere 26. In this embodiment, any path 27 can be chosen and no discontinuity is encountered, enabling very thin objects, such as paper currency bills, to slide up the surface.

In FIGS. 5, 6, and 7, cylindrical and spherical surfaces are illustrated which form surface 11 of the trough 15. Of course any curved surface will suffice as long as no discontinuity in the surface is present which captures a sliding object. Let F(x,y,z) be a function of dimensional coordinates x,y, and z, as in FIGS. 2 and 7, which function F(x,y,z) defines the entirety of surface 11 of the cylinder, sphere, or whatever curved surface is used. In order that no obstacle to a sliding object is encountered along any path leading from the bottom of trough 15 to surface 18 or 21, the boundary of the enclosure, F(x,y,z) must be continuous, as defined by the standard science of calculus to mean that all three of the following conditions are met for all possible values of a parameter (a) between zero and the maximum of x or y or z on the sliding surface:

(1) F(a) exists, (x=z, or y or z)

(2) Lim F(x) exists, as x approaches a, (or y or z)

(3) Lim F(x)=F(a), as x approaches a, (or y or z)

In most cases, the second derivative of F(x,y,z) will be a constant and the third derivative will be zero, each as evaluated anywhere along the sliding surface, said derivatives being defined according to the standard science of calculus.

Figure 4:
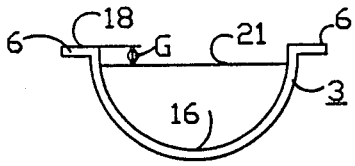
FIG. 4 is an elevation view of the drawer as shown in FIG. 2.

With reference to FIG. 4, it is shown that a gap G exists between the top surface 21 of ramps 3 and 4 and top surface 18 of trough 5. The purpose of gap G is to leave room between surface 21 and tray 2 so that the user of wheelchair 1 can insert his/her fingers through gap G and pull or push on drawer 3 to open or shut it. While a gap G is shown with both rear ramp 3 and forward ramp 4, of course it may be desired to provide such a gap only at rear ramp 3 for the use of the occupant of wheelchair 1.

It is possible to construct tray 2 of a translucent material in order that the occupant of wheelchair 1 can see the contents of drawer 3 and can monitor the removal of objects.

In this specification, in the drawings, and in the claims, a general concept has been described which can be modified in many ways without departure from the true spirit and scope of the invention. For example, the geometry of drawer 3 need not be a combination of a cylinder and two ramps, or a bowl-like hollow sphere, but may rather be even an irregular geometry which nevertheless enables a continuous sliding of an object from the bottom of drawer 3 to a top edge from which it can be removed. An elliptical surface would suffice. Therefore this disclosure should be considered illustrative rather than limiting.

In the claims, the term "object" should be construed to mean any small slidable item, specifically including United States and foreign coins and currency of all monetary denominations, and valuable tokens such as theater tickets. Also in the claims, the term "continuous" should be interpreted according to the mathematical definition herein.

I claim:

1. A wheelchair attachable tray comprising:

(a) support means for detachably mounting said tray to said wheelchair;

(b) drawer support means, attached to said tray, for support of a drawer;

(c) a drawer, slidably mountable in said drawer support means, comprising an enclosure for the storage of objects, wherein said enclosure has a first surface for placement of said objects, wherein said first surface is continuous, defined to mean that sliding travel of said objects along any path from any point on said first surface in a direction toward a boundary of said enclosure for removal of said objects from said enclosure, encounters no obstacle to continued sliding of said objects, especially meaning that no edge and no step is encountered along any such path to hinder sliding movement of said objects therethrough complete movement of said objects to and past said boundary thereby removing said objects from said enclosure, wherein said enclosure is geometrically a section of a cylinder, sectioned along its axis, closed at one end by a flat ramp which intersects said cylinder at an angle sufficiently large that said object is slidable over the intersection without hindrance.

2. A wheelchair attachable tray comprising:

(a) support means for detachably mounting said tray to said wheelchair;

(b) drawer support means, attached to said tray, for support of a drawer;

(c) a drawer, slidably mountable in said drawer support means, comprising an enclosure for the storage of objects, wherein said enclosure has a first surface for placement of said objects, wherein said first surface is continuous, wherein said enclosure is geometrically a section of a cylinder, sectioned along its axis, closed at one end by a flat ramp which intersects said cylinder at an angle sufficiently large that said object is slidable over the intersection without hindrance.

* * * * *